US006973945B2

(12) United States Patent
Haimi

(10) Patent No.: US 6,973,945 B2
(45) Date of Patent: Dec. 13, 2005

(54) VACUUM BOTTLE CAP

(76) Inventor: Shlomo Haimi, 641/10 Balfore St., Or Akiva (IL)

( * ) Notice: Subject to any disclaimer, the term of this patent is extended or adjusted under 35 U.S.C. 154(b) by 0 days.

(21) Appl. No.: 10/725,007

(22) Filed: Dec. 2, 2003

(65) Prior Publication Data

US 2005/0115632 A1 Jun. 2, 2005

(51) Int. Cl.[7] ..... B65B 31/04
(52) U.S. Cl. ..... 141/65; 141/94; 141/95; 220/203.06; 220/231
(58) Field of Search ..... 141/8, 63–65, 141/83, 94, 95; 220/203.04, 231, 203.05, 220/235, 203.06, 212, 257, 303, 360, 257.1; 215/228, 260, 262, 269, 270

(56) References Cited

U.S. PATENT DOCUMENTS 5,944,212 A * 8/1999 Chang ..... 220/212
5,961,000 A * 10/1999 Sanfilippo et al. ..... 222/152
6,131,753 A * 10/2000 Lynch ..... 215/228

* cited by examiner

*Primary Examiner*—Timothy L. Maust
(74) *Attorney, Agent, or Firm*—Mark M. Friedman

(57) ABSTRACT

The present invention is a container lid assembly that includes an integral vacuum pump so as to create at least a partial vacuum within the container. There are several features of the present invention that can be used in synergy, but are of value when implemented separately. These features include a pump configuration that activates the reciprocating linear motion of the piston by the rotational movement of a pump actuating element; a contents-dispensing mechanism for removing contents from the container while maintaining the at least a partial vacuum within the container; a selectively activated lid-removal mechanism (child proof mechanism); a vacuum indicator; and a filter configured to filter the gases entering the pump from the interior of the container.

11 Claims, 8 Drawing Sheets

Annotated Sheet Showing Changes

VACUUM BOTTLE CAP

FIELD AND BACKGROUND OF THE INVENTION

The present invention relates to lids that create a vacuum within the container on which the lid is deployed and, in particular, it concerns a lid assembly with an integral vacuum pump, in which the reciprocating linear motion of the piston is actuated by rotational movement of a pump actuating element.

Several bottle cap devices are know that are configured for use in conjunction with a separate pump such that once the vacuum is created, the pump is disconnected from the cap. These devices suffer from the need to store the pump while not in used and prevent loss of the pump during such storage. Further, some of the dump mechanisms for devices of this type are expensive electrical devices that are inappropriate for consumers with a small number of containers requiring vacuum sealing.

One attempt to provide a bottle cap with an integral vacuum pump is disclosed in U.S. Pat. No. 6,637,321 to Wang. Wang's cap includes a piston style pump, the cylinder of which is deployed inside of the container on which the cap is deployed. A handle is formed on the exposed end of the piston, and the pump is operated by a push-pull motion. One drawback to this style of pump is the length of piston stroke necessary for efficient pumping. Therefore, the cylinder extends relatively far into the container, or in the case of U.S. Pat. No. 5,535,900 to Huang, the pump extends above the bottle.

Further, the bottle caps mentioned above require removal of the cap in order to access to contents of the bottle. Nor do the devices of prior art include a vacuum indication mechanism or a filter for use with powered contents in the container.

There is therefore a need for a container lid assembly with an integral vacuum pump, in which the reciprocating linear motion of the piston is actuated by rotational movement of a pump actuating element. It would be beneficial for the lid assembly to provide access to the contents of the container while maintaining the vacuum. It would be of further benefit for the lid assembly to include a vacuum indicator. It would also be beneficial for the lid assembly to include a vacuum indicator.

SUMMARY OF THE INVENTION

The present invention is a lid assembly with an integral vacuum pump, in which the reciprocating linear motion of the piston is actuated by rotational movement of a pump actuating element.

According to the teachings of the present invention there is provided, a lid assembly for creating a partial vacuum within a container, the lid assembly comprising: (a) a seat-portion for sealing connection to the container; (b) a pump configuration associated with the seat-portion and configured with a pumping element actuated in a reciprocating linear motion to pump gas from within the container to an external atmosphere; and (c) a rotatable actuating element mechanically associated with the pump configuration such that continuous rotation of the actuating element in a given rotational direction generates the reciprocating linear motion of the pumping element, thereby expelling a quantity of gas from the container to generate at least a partial vacuum.

According to a further teaching of the present invention, the actuating element substantially circumscribes at least a portion of the pump configuration such that the continuous rotation is about the pump configuration.

According to a further teaching of the present invention, one of the pumping element and the actuating element includes a longitudinally-wave-like groove, and the other of the pumping element and the actuating element includes at least one pump activation pin configured to engage the wave-like groove, such that during the continuous rotation the activation pin contacts an edge of the longitudinally-wave-like groove, thereby generating the reciprocating linear motion.

According to a further teaching of the present invention, the pumping element is a substantially cylindrical piston element, an outer surface of which is a circumferential wall configured with the groove circumscribing the wall so as to form a single continuous groove; and the actuating element includes the at least one pump activation pin.

According to a further teaching of the present invention, there is also provided a contents-dispensing mechanism for removing non-gaseous contents from the container while maintaining the at least a partial vacuum.

According to a further teaching of the present invention, the contents-dispensing mechanism includes a rotatable dispensing element deployed in the seat-portion, the dispensing element configured with a contents receptacle, and the dispensing element rotatable such that the contents receptacle is alternately alignable with a contents inlet, opening into the interior volume, and a contents outlet, opening to the exterior atmosphere, the contents inlet and the contents outlet being spaced apart such that as the contents receptacle alternates between the contents inlet and the contents outlet the contents receptacle passes through a region in which fluid communication between the contents receptacle and one of the contents inlet and the contents outlet is fully interrupted before fluid communication is established with an other of contents inlet and the contents outlet.

According to a further teaching of the present invention, there is also provided a ratchet mechanism to limit rotation of the actuating element to the given rotational direction.

According to a further teaching of the present invention, there is also provided a lid-removal mechanism configured to selectively limit rotation of the actuating-ring in relation to the seat-portion.

According to a further teaching of the present invention, the lid-removal mechanism is engaged by displacing the actuating element a pre-limited distance in a direction longitudinally away from the container and displacing at least a portion of the actuating element inward toward the seat-portion so as to engage complementary teeth configured in both the actuating element and the seat-portion.

According to a further teaching of the present invention, there is also provided a vacuum indicator.

According to a further teaching of the present invention, the vacuum indicator is configured as a passage with at least one opening to the interior volume of the container and at least one opening to the exterior atmosphere, the opening to the exterior atmosphere being closed by a vacuum indicating element that is displaceable between two different states so as to indicate vacuum and non-vacuum states within the interior of the container.

According to a further teaching of the present invention, the vacuum indicating element is configured from resilient material biased to a first state, so as to indicate the non-vacuum state, and displaceable to a second state, so as to indicate the vacuum state.

According to a further teaching of the present invention, the pump configuration includes at least one one-way inlet valve and at least one one-way outlet valve.

According to a further teaching of the present invention, there is also provided a filter element associated with the one one-way inlet valve.

There is also provided according to the teachings of the present invention, a lid assembly for removing contents from a container in which a partial vacuum has been created while maintaining the vacuum in the container, the lid assembly comprising: (a) a seat portion configured for attaching the lid assembly to the container; (b) a contents inlet configured in the set-portion, the contents inlet opening into an interior volume of the container; (c) a contents outlet configured in the seat-portion, the contents outlet opening to a exterior atmosphere of the container; (d) a rotatable dispensing element deployed in the seat-portion; and (e) a contents receptacle configured in the dispensing element, the dispensing element rotatable such that the contents receptacle is alternately alignable with the contents inlet and the contents outlet; wherein the contents inlet and the contents outlet are spaced apart such that as the contents receptacle alternates between the contents inlet and the contents outlet the contents receptacle passes through a region in which fluid communication between the contents receptacle and one of the contents inlet and the contents outlet is fully interrupted before fluid communication is established with an other of contents inlet and the contents outlet.

According to a further teaching of the present invention, the rotatable dispensing element is actuated by a rotatable shaft manipulated from an exterior of the seat-portion.

According to a further teaching of the present invention, the rotatable dispensing element is configured as a substantially spherical element.

There is also provided according to the teachings of the present invention, a screw on lid assembly for a container, the lid assembly configured to selectively limit removal of the lid assembly from the container, the lid assembly comprising: (a) a seat-portion for attaching the lid assembly to the container, the seat-portion including a substantially cylindrical lid body; and (b) a rotating actuating ring rotatably attached to the seat-portion so as to circumscribe the cylindrical body, at least a portion of the actuating ring configured as a locking tab being displaceable between a normal free-rotation position, in which the actuating-ling is free to rotate in relation to the seat-portion, and a locked non-rotation position, in which the position of the actuating-ring is locked in relation to the seat-portion; wherein the locked position is engaged by displacing the actuating-ring a pre-determined distance in a direction longitudinally away from the container and displacing the locking tab inward toward the seat-portion so as to engage complementary teeth configured in both the actuating-ring and the seat-portion.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a lid assembly with an integral vacuum pump, in which the reciprocating linear motion of the piston is actuated by rotational movement of a pump actuating element.

The principles and operation of a lid assembly with an integral vacuum pump according to the present invention may be better understood with reference to the drawings and the accompanying description.

By way of introduction, the present invention is a container lid assembly that includes an integral vacuum pump so as to create at least a partial vacuum within the container. As used herein, the terms "vacuum" and "partial vacuum" are used interchangeably and are consider to be synonymous, referring to any state of partial vacuum up to and including a state of complete vacuum. As will be discussed below, there are several features of the present invention that can be used in synergy as illustrated by the preferred embodiments, but are of value when implemented separately. These features include a pump configuration that activates the reciprocating linear motion of the piston by the rotational movement of a pump actuating element; a contents-dispensing mechanism for removing contents from the container while maintaining the at least a partial vacuum within the container; a selectively activated lid-removal mechanism (childproof mechanism); a vacuum indicator; and a filter configured to filter the gases entering the pump from the interior of the container.

Figure 1:
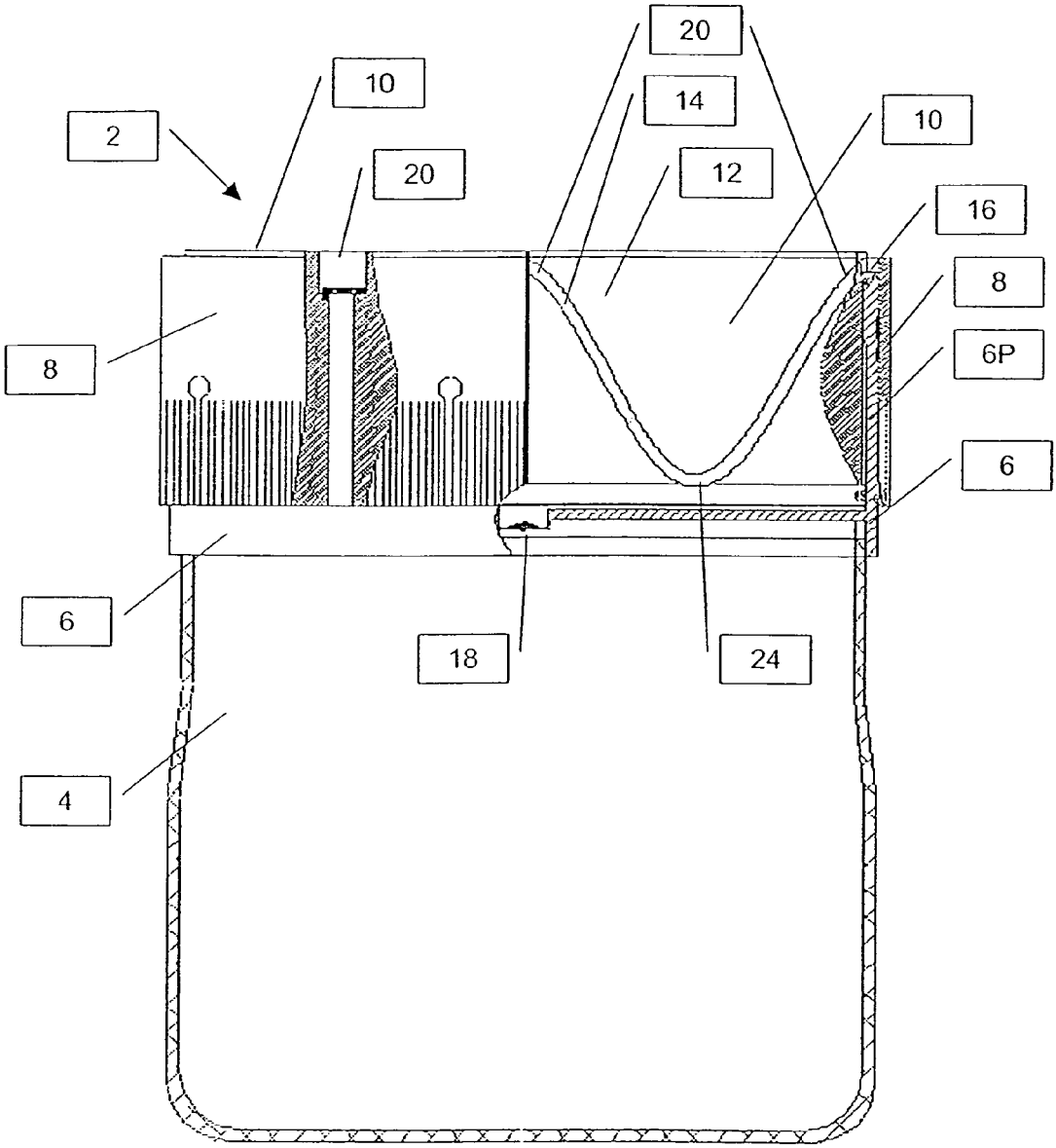
FIG. 1 is a partial cut-away side view of a first preferred embodiment of a lid assembly, constructed and operable according to the teachings of the present invention, deployed on a container.
Figure 4:
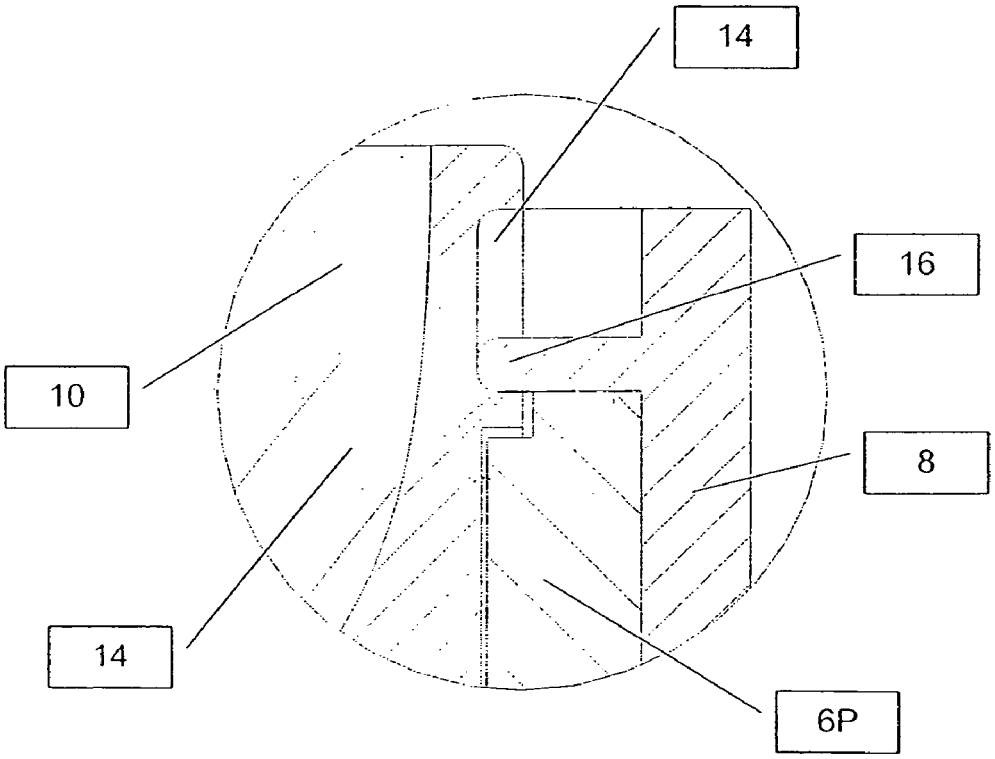
FIG. 4 is a detail of region S of FIG. 2.
Figure 5:
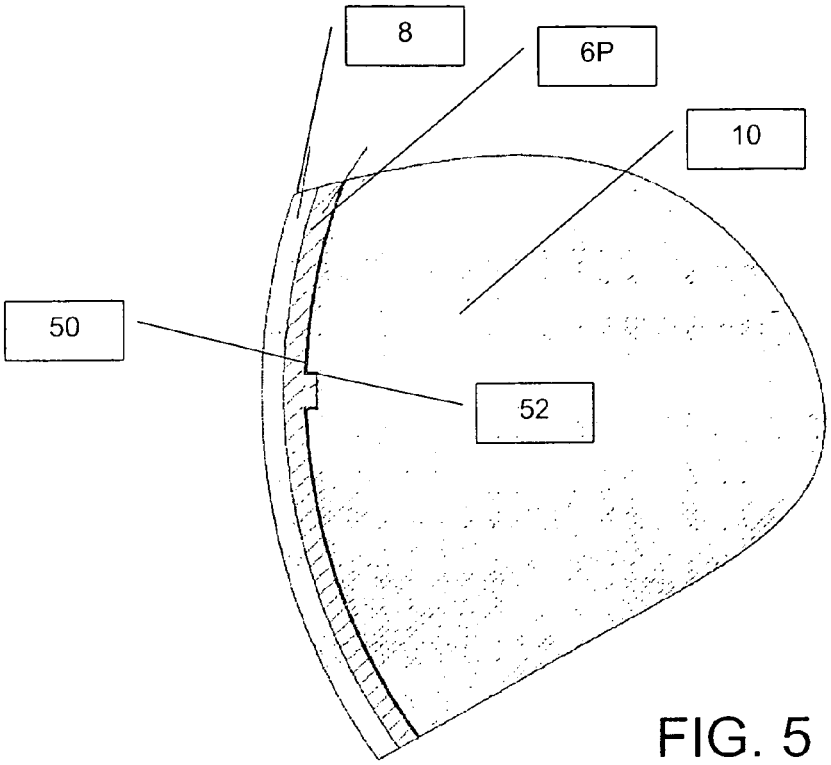
FIG. 5 is a detail of a cross section taken along line B—B of FIG. 2.

Referring now to the drawings, FIG. 1 illustrates basic principles of the pump configuration according to the teachings of the present invention. The first embodiment of a lid assembly 2 is secured on the container 4 by seat-portion 6. A portion of the seat-portion is configured so as to define at least part of a pump cylinder 6P. Circumscribing at least a portion of the pump cylinder 6P is a piston actuating ring 8. A substantially cylindrical pump piston 10 is deployed in the pump cylinder 6P such that a variable pump volume is defined between them. The circumferential wall 12 of the piston is configured with a longitudinally-wave-like groove 14 that circumscribes the piston and joints itself at a point of origin so as to form a single continuous groove. As see in better detail in FIG. 4, the piston actuating ring 8 is configured with a pump activation pin 16 that extends into the groove 14. As the actuating ring 8 is rotated about the pump cylinder 6P and the piston 10, the pump activating pin 16 contacts the edge of the groove 14. Due to the angle of the groove 14 in relation to the direction of the movement of the pump activating pin 16, the torque of the actuating ring 8 is translated into linear motion of the piston 10. The wave-like configuration of the groove 14, therefore, results in reciprocating linear motion of the piston 10. As the piston 10 moves in a linear direction away from the container 4, the variable pump volume increases in volume and gases are drawn from the interior of the container 4 into the pump through the one-way pump inlet valve 18. It will be appreciated that a configuration in which the wave-like groove is configured in the actuating ring and the pump activating pin configured in the piston is within the spirit of the present invention.

Figure 6:
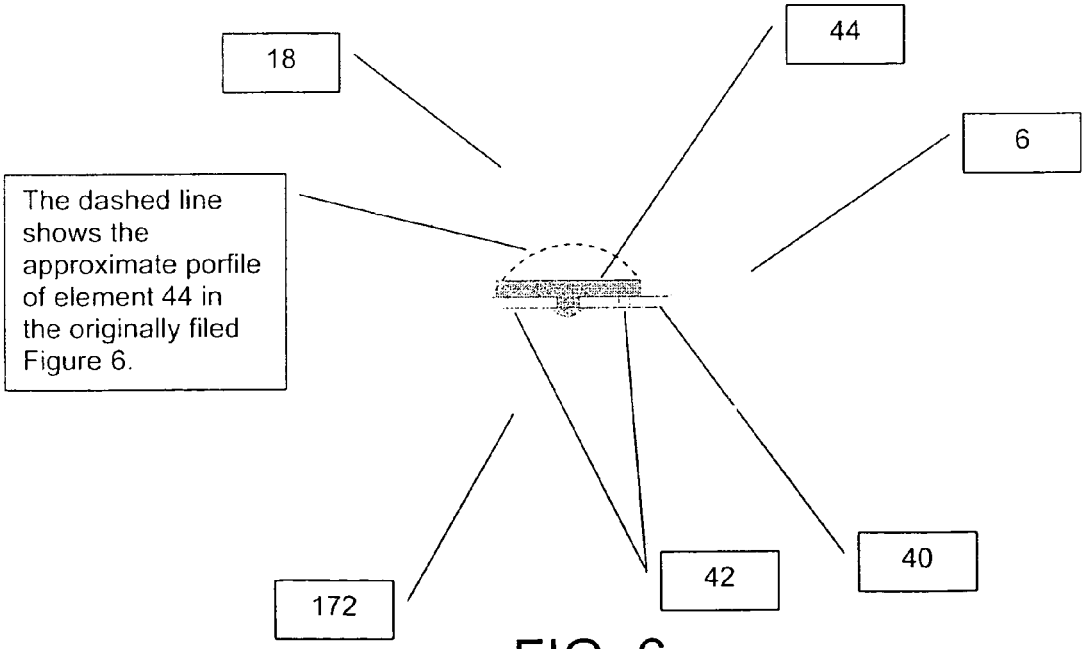
FIG. 6 is a detail of region W of FIG. 2.

As illustrated in FIG. 6, the pump inlet valve 18 may consist of a valve base 40 having at least one passageway 42 through which gases may pass from the interior of the container to the variable pump volume. The passageways 42 are sealed by a resilient sealing element 44. The resilient sealing element 44 is deformable from a normally closed state, in which no gases may pass between the interior of the container and the variable pump volume, and an open state in which gases may pass between the interior of the container and the variable pump volume. Deformation of the resilient sealing element 44 is affected increasing the volume within the variable pump volume such that atmospheric pressure in the variable pump volume is less than the atmospheric pressure within the interior of the container, at which time the pressure of the gases in the container force the deformation of the resilient sealing element 44. As the piston 10 moves in a linear direction toward the container 4, the variable pump volume decreases in volume, pressure in the variable pump volume increases, and gases are forced from the pump to the surrounding atmosphere through the one-way valve 20.

In the preferred embodiments illustrated herein, the groove 14 is configured with four equally spaced apart crests 22 and therefore four equally spaced apart troughs 24, and the actuating ring is configured with four pump activating pins 16, spaced at intervals of 90°. Such a configuration results in four reciprocating linear motions of the piston 10 per one revolution of the actuating ring 8. It will be appreciated that the number of the wave crests 22 and troughs 24 may be varied to suit the circumference of the piston 10. Further, the piston may be actuated by only one or any number of activating pins 16, however, it is preferable that the number of activating pins 16 be equal to the number of wave crests 22.

It will be appreciated that when the actuating ring 8 is rotated, the torque of the actuating ring 8 will cause a rotationally unchecked piston 10 to rotate within the cylinder 6P rather than the desired linear movement. Therefore, in some embodiments, rotation of the piston 10 within the cylinder 6P, when torque is applied by the actuating ring 10, is restricted by a pin 50 extending from the wall of the cylinder 6P, for example, inserted into a groove 52 in the wall of the piston 10, for example. In some alternative embodiments having a central stabilization post 122 (see FIG. 2), rotation of the piston 10 within the cylinder 6P may be restricted by and pin and groove associated with the interface of the piston 10 and the central stabilization post 122, or the central stabilization post 122 may be configured with any rotation restricting cross section, such as but not limited to, substantially any closed geometric shape having one or more angles and substantially any smooth closed curve other than a circle.

Figure 3:
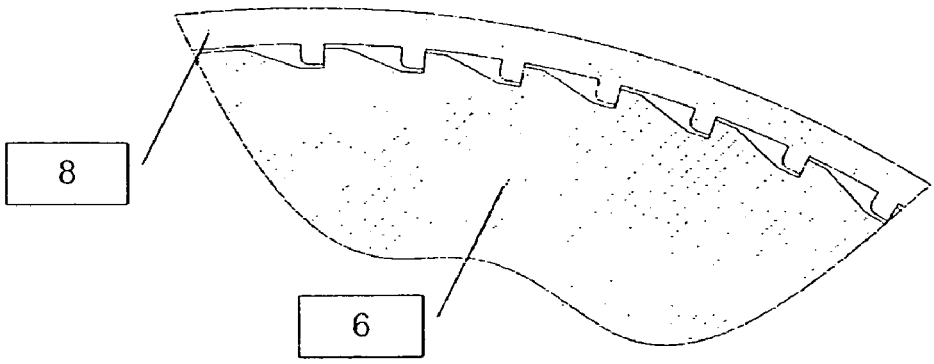
FIG. 3 is a detail of a cross section taken along line C—C of FIG. 2.

Since the actuating ring 8 is free to rotate about the seat-portion 4, in some embodiments of the present invention it is necessary to limit the rotation of the actuating ring 8 to one direction to facilitate screw attachment of the lid assembly 2 to the container 4. FIG. 3 illustrates a first preferred ratcheting configuration that limits rotation of the actuating ring 8 to a counter-clockwise direction in relation to the seat-portion 6 of the lid assembly 2. Once rotation of the actuating ring 8 is thusly limited, the lid assembly 2 is attached to the container 4 by rotating the actuating ring 8, and therefore the seat-portion, in a clockwise direction until a vacuum tight seal is formed between the seat-portion 6 and the container 4. Actuation of the piston 10 in order to create a vacuum state within the container 2 is achieved by rotating the actuating ring 8 in a counter-clockwise direction.

Figure 2:
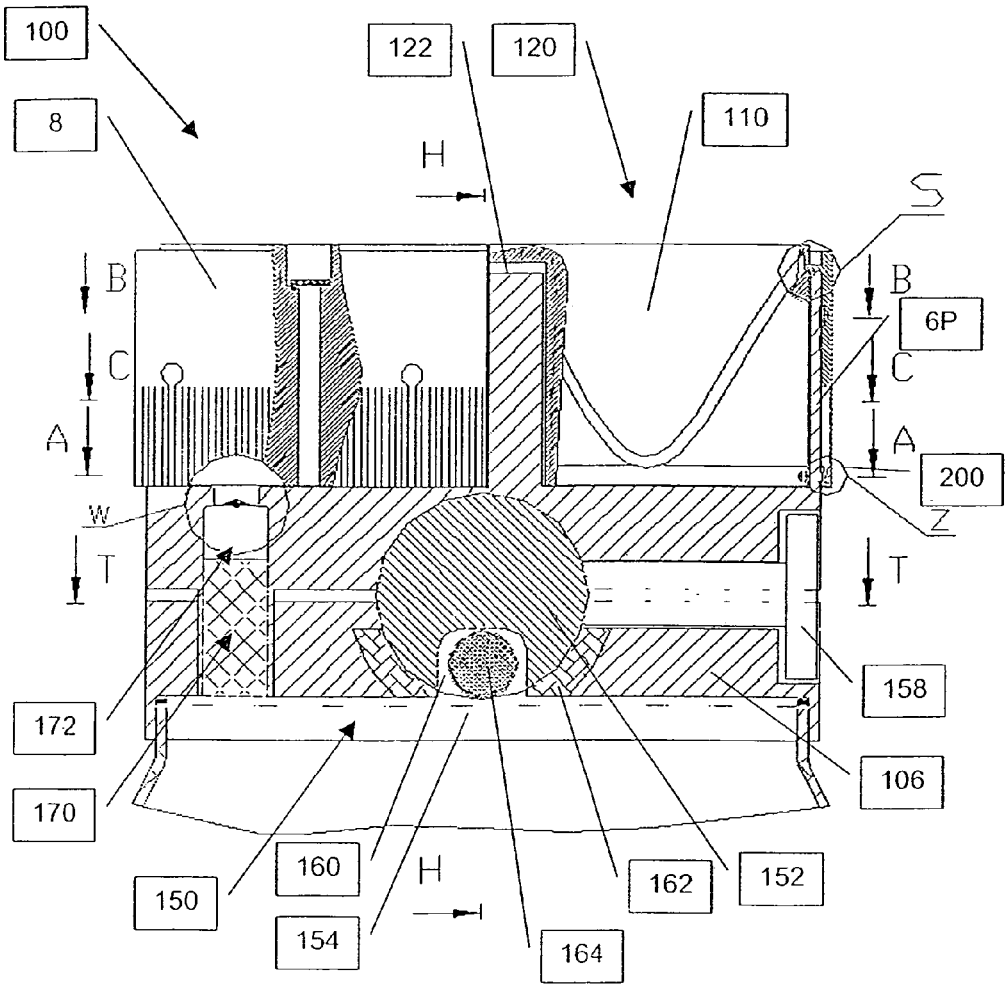
FIG. 2 is a partial cut-away side view of a second preferred embodiment of a lid assembly constructed and operable according to the teachings of the present invention.

FIG. 2 illustrates a second embodiment of a lid assembly 100 configured to include a number of the major features of the present invention as mentioned above, specifically, a pump configuration 120; a contents-dispensing mechanism 150; a selectively activated lid-removal mechanism (child-proof mechanism) 200; and a filter 170. The pump configuration illustrated here is similar to the pump configuration of FIG. 1, with the addition of a central stabilization post 122 extending from the seat-portion of the lid assembly 100 into the center of the pump cylinder. The piston 10 is configured as an annulus that circumscribes the stabilization post 122 within the pump cylinder.

Figure 7:
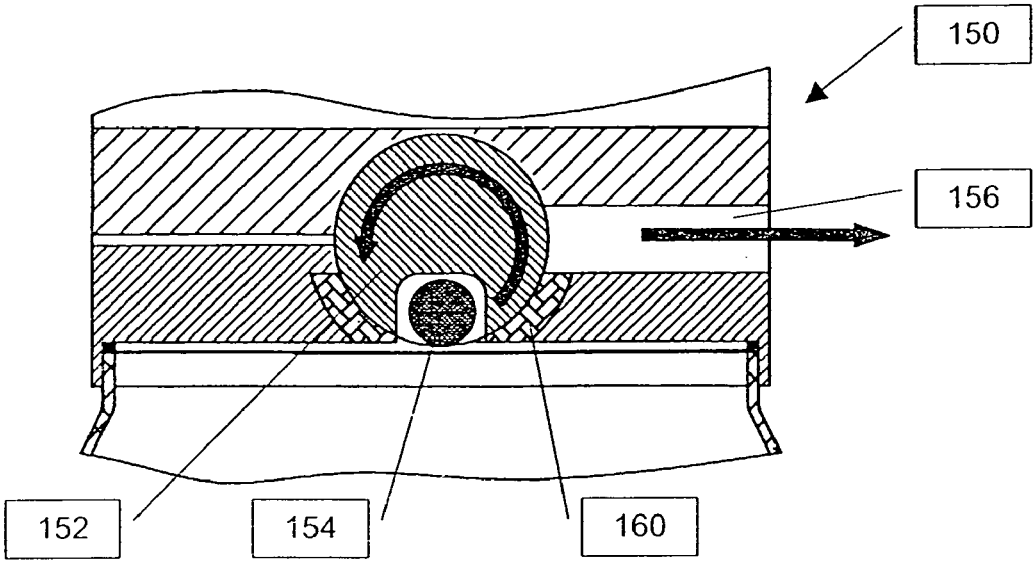
FIG. 7 is a detail of a cross section taken along line H—H of FIG. 2.
Figure 8:
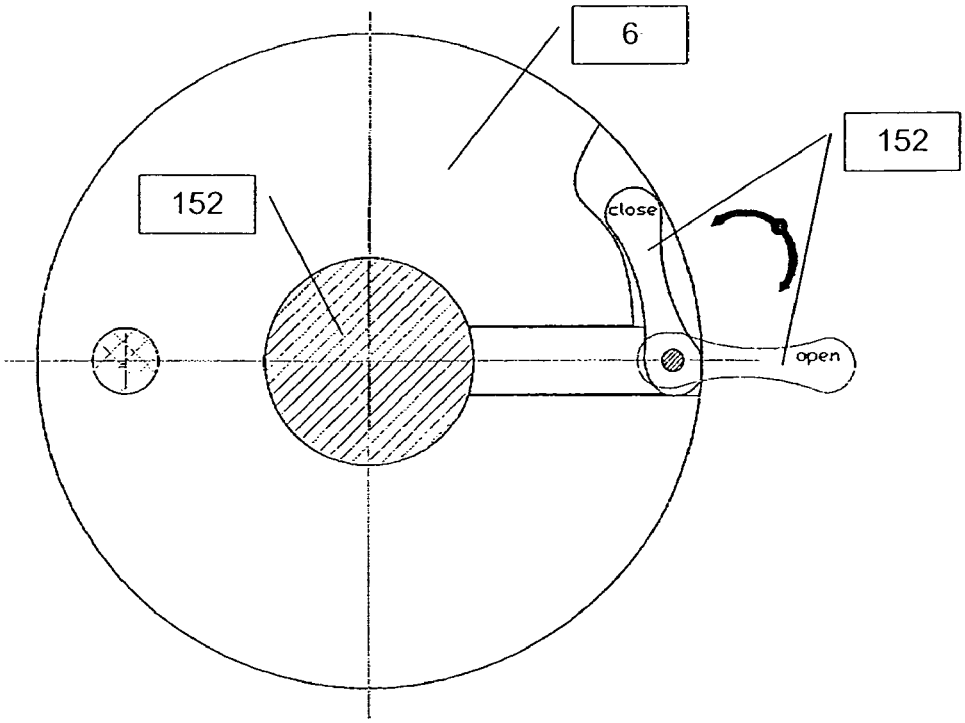
FIG. 8 is a cross section taken along line T—T of FIG. 2.
Figure 9:
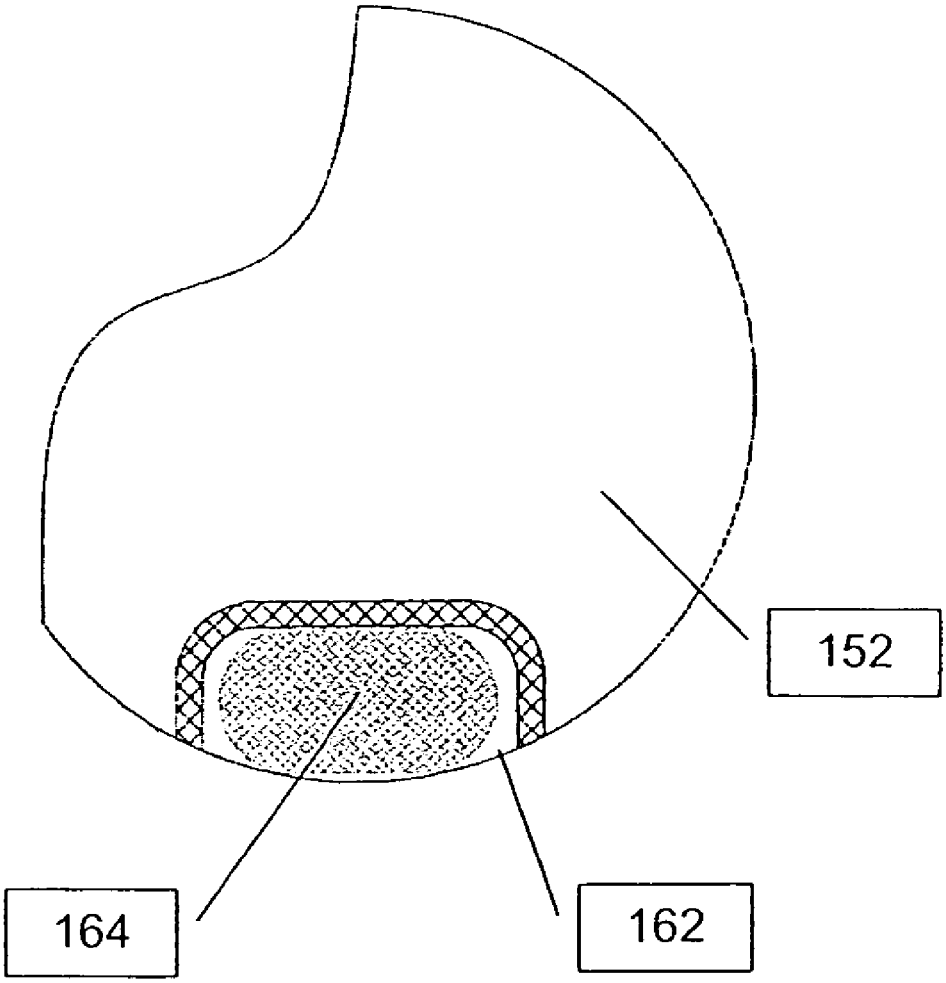
FIG. 9 is a detail showing an alternate contents receptacle constructed and operable according to the teachings of the present invention.

In some application, once a vacuum is created within the container it is desirable to remove at least some of the contents while maintaining the vacuum state. The present invention therefore provides a contents-dispensing mechanism 150 configured in the seat-portion 106 of the lid assembly 100. The contents-dispensing mechanism 150 includes a rotatable dispensing element 152 that is rotatable such that a contents receptacle 160 travels between a contents inlet 154 and a contents outlet 156 (see FIG. 7). The contents inlet 154 and a contents outlet 156 are spaced apart such that the as the dispensing element is rotated the contents receptacle passes through a region in which fluid communication between the contents receptacle and either the contents inlet or the contents outlet is fully interrupted before fluid communication is established with the other of either the contents inlet or contents outlet. The dispensing element 152 is actuated by the dispensing handle 158, which may be rotated between an open and a closed state (see FIG. 8). It is preferable that the dispensing element 152 be seated in a vacuum seal seat 162 so as to prevent a vacuum leak between the dispensing element 152 and the seat-portion 106 of the lid assembly 100. It should be noted that the dispensing element 152 may be of substantially any suitable shape, such as but not limited to, a sphere (as illustrated herein) and a cylinder. Further, the contents receptacle 160 may be of substantially any suitable size or shape corresponding to the contents 164 of the container, as illustrated in FIG. 9. The contents receptacle 160 may be configured to hold a predetermined number, for example, 1, 2 or more, of individual contents items, such as but not limited to pills and capsules. Alternately, the contents receptacle 160 may be configured to hold a predetermined amount or volume of contents, such as but not limited to, powdered, granulated, and liquid contents. In some embodiments, the dispensing element 152 may be biased to a normal state in which the contents receptacle 160 is aligned with the contents inlet 154. That is, after the contents have been dispensed through the contents outlet 156, the dispensing element 152 will automatically return to a position in which the contents receptacle 160 is in fluid connection with the interior of the container 4.

Figure 10:
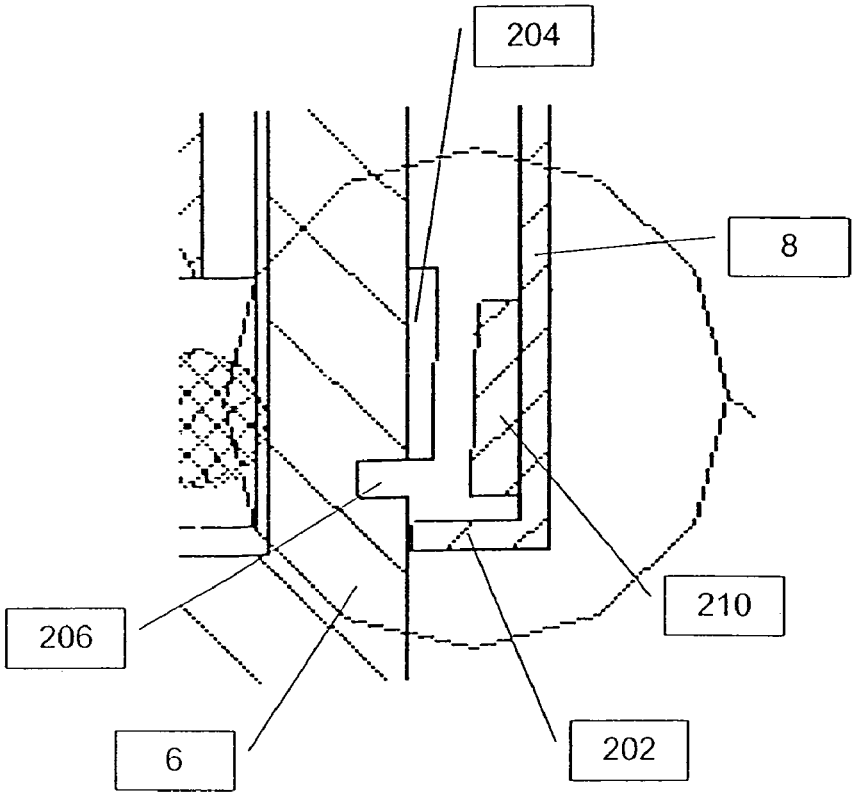
FIG. 10 is a detail of region Z of FIG. 2.
Figure 11:
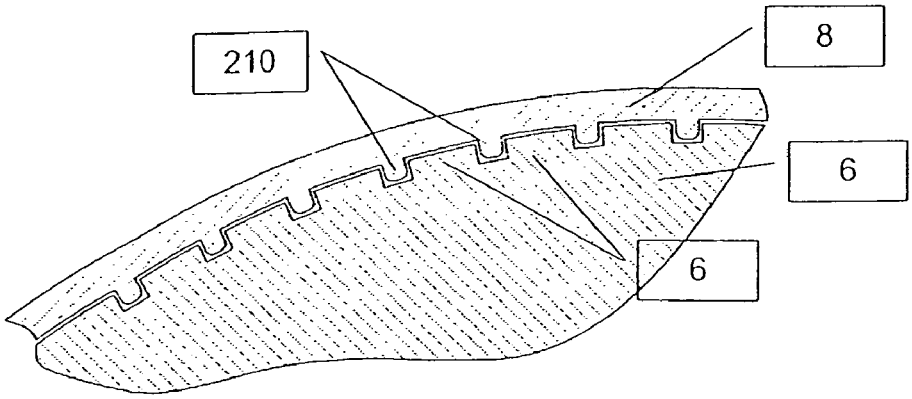
FIG. 11 is a detail of a cross section taken along line A—A of FIG. 2.

In some applications, controlling access to the contents of the container may be of concern, such as keeping children from opening medication containers, for example. In such application, the actuating ring 8 is configured with a selectively engagable lid-removal mechanism 200 (see FIGS. 2 and 10). In a normally relaxed state, the actuating ring 8 is biased, by either gravity or a spring configuration for example, such that an inwardly extending lip 202 rests of the outer surface of the seat-portion 6. In order to unscrew the lid assembly 2 from the container 4, the actuating ring 8 is raise, or moved longitudinally away from the container until lip 202 strikes the bottom edge of a plurality of teeth 204 that circumscribe the outer surface of the seat-portion 6, at which point the lip 202 is aligned with groove 206 which also circumscribes the seat-portion 6. At least a portion of the actuating ring 8 is then compressed inwardly such that at least a portion of lip 202 enters groove 206 and a number of complementary teeth 210, which circumscribe the inner surface of the actuating ring, engage a number of teeth 204. Rotation of the actuating ring 8 in relation to the seat-portion 6 is thereby locked and the lid assembly may be unscrewed by rotating the actuating ring 8, and therefore the entire lid assembly 2. Removal of the lid assembly therefore is a three-step process. First, lifting the actuating ring, then pressing a portion of the actuating ring against the set-portion, and finally turning the lid assembly.

In some applications of the present invention, it may be desirable to filter the gases leaving the interior of the container before the gases enter the pump configuration. This will be especially true if the contents of the container are in a powdered state. Therefore, some embodiments of the present invention are configured with a filter 170 deployed in a passageway 172 through the seat-portion 6 connecting the interior of the container to the variable pump volume within the pump configuration. The filter 170 may be permanently installed during manufacture, or the filter 170 may be a replaceable filter.

Figure 12:
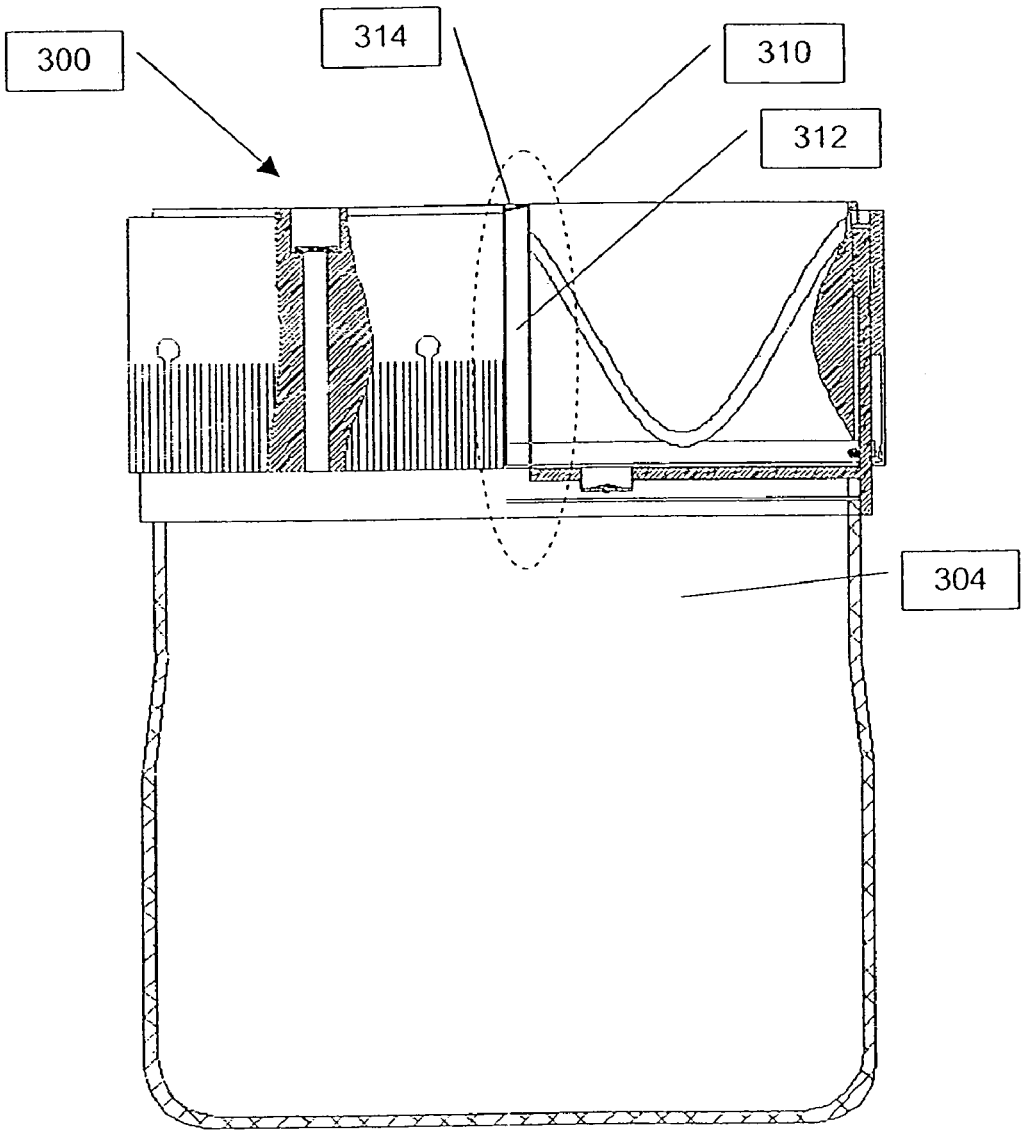
FIG. 12 is a partial cut-away side view of the lid assembly and container of FIG. 1 with the addition of a vacuum indicator constructed and operable according to the teachings of the present invention.

FIG. 12 illustrates a lid assembly 300 constructed and operable according to the teachings of the present invention and including a vacuum indicator 310. As illustrated here, the vacuum indicator 310 is configured as a passageway 312 through the lid assembly 300 extending between the interior 304 of the container and the exterior atmosphere. The passageway 312 is closed by a vacuum indicating element 314. The vacuum indicating element illustrated here is plug 314 configured from a resilient material that is deformable between a first formation, which indicates that the interior 304 of the container is in a non-vacuum state, and a second formation that indicates that the interior 304 of the container is in a vacuum state. In the first formation, the plug 314 is normally biased so as to be substantially planar. In the second formation, the atmospheric pressure outside the container is greater than the pressure inside the container such that the plug 314 is deformed inwardly in a cupped formation. It should be noted that the vacuum indicating element may be configured as, by non-limiting example, a button on a stem, which seals the passageway, that is normally biased to extend above the top surface of the piston 10, and when a vacuum state is created within the interior of the container, the button is drawn downward.

In use, operation of the lid assembly is as follows:

1—The lid is deployed on the opening of the container.

2—The lid assembly is attached to the container. This may be accomplished, for example, by rotating the lid assembly in a clockwise direction until a vacuum tight seal is formed between the lid assembly and the container.

3—The actuating ring is rotated counter-clockwise so as to actuate the piston and remove at least some of the gases form the interior of the container. The number of turns may be determined by the number of piston strokes per revolution of the actuating ring, the amount of gases removed from the container per piston stroke (generally the displacement of the piston), and the amount of gases to be removed form the container. In embodiments with a vacuum indicator, the actuating ring is rotated until the vacuum indicator indicates sufficient vacuum has been achieved.

4—To dispense a portion of the contents of the container, the container is tipped as least partially upside down such that at least some of the contents contact the surface of the lid assembly exposed to the interior of the container, and an amount of contents enters the contents receptacle.

5—The dispensing handle is rotated so as to bring the contents receptacle into alignment with the contents outlet and the contents are removed.

6—When it is necessary to remove the lid assembly from the container, the actuating ring is pulled up (or away from the container), at least a portion of the actuating ring is compressed such that complementary teeth in both the actuating ring and the seal-portion engage, and the lid assembly is rotated in a counter-clockwise direction.

It will be appreciated that the above descriptions are intended only to serve as examples, and that many other embodiments are possible within the spirit and the scope of the present invention.

What is claimed is:

1. A lid assembly for creating a partial vacuum within a container, the lid assembly comprising:

a) a seat-portion for sealing connection to the container;

b) a pump configuration associated with said seat-portion and configured with a pumping element actuated in a reciprocating linear motion to pump gas from within the container to an external atmosphere; and c) a rotatable actuating element mechanically associated with said pump configuration, and said actuating element substantially circumscribes at least a portion of said pump configuration, such that continuous rotation of said actuating element in a given rotational direction generates said reciprocating linear motion of said pumping element about said pump configuration, thereby expelling a quantity of gas from the container to generate at least a partial vacuum; wherein one of said pumping element and said actuating element includes a longitudinally-wave-like groove, and the other of said pumping element and said actuating element includes at least one pump activation pin configured to engage said wave-like groove, such that during said continuous rotation said activation pin contacts an edge of said longitudinally-wave-like groove, thereby generating said reciprocating linear motion.

2. The lid assembly of claim 1, wherein said pumping element is a substantially cylindrical piston element, an outer surface of which is a circumferential wall configured with said groove circumscribing said wall so as to form a single continuous groove; and said actuating element includes said at least one pump activation pin.

3. The lid assembly of claim 1, further including a contents-dispensing mechanism for removing non-gaseous contents from the container while maintaining said at least a partial vacuum.

4. The lid assembly of claim 3, wherein said contents-dispensing mechanism includes a rotatable dispensing element deployed in said seat-portion, said dispensing element configured with a contents receptacle, and said dispensing element rotatable such that said contents receptacle is alternately alignable with a contents inlet, opening into said interior volume, and a contents outlet, opening to said exterior atmosphere, said contents inlet and said contents outlet being spaced apart such that as said contents receptacle alternates between said contents inlet and said contents outlet said contents receptacle passes through a region in which fluid communication between said contents receptacle and one of said contents inlet and said contents outlet is fully interrupted before fluid communication is established with an other of contents inlet and said contents outlet.

5. The lid assembly of claim 1, further including a ratchet mechanism to limit rotation of said actuating element to said given rotational direction.

6. The lid assembly of claim 1, further including a lid-removal mechanism configured to selectively limit rotation of said actuating-ring in relation to said seat-portion.

7. The lid assembly of claim 6, wherein said lid-removal mechanism is engaged by displacing said actuating element a pre-limited distance in a direction longitudinally away from the container and displacing at least a portion of said actuating element inward toward said seat-portion so as to engage complementary teeth configured in both the actuating element and said seat-portion.

8. The lid assembly of claim 1, further including a vacuum indicator.

9. The lid assembly of claim 8, wherein said vacuum indicator is configured as a passage with at least one opening to said interior volume of the container and at least one opening to said exterior atmosphere, said opening to said exterior atmosphere being closed by a vacuum indicating element that is displaceable between two different states so as to indicate vacuum and non-vacuum states within said interior of the container.

10. The lid assembly of claim 9, wherein said vacuum indicating element is configured from resilient material biased to a first state, so as to indicate said non-vacuum state, and displaceable to a second state, so as to indicate said vacuum state.

11. A lid assembly for creating a partial vacuum within a container, the lid assembly comprising:

a) a seat-portion for sealing connection to the container;

b) a pump configuration associated with said seat-portion and configured with a pumping element actuated in a reciprocating linear motion to pump gas from within the container to an external atmosphere, and said pump configuration includes at least one one-way inlet valve and at least one one-way outlet valve;

c) a rotatable actuating element mechanically associated with said pump configuration such that continuous rotation of said actuating element in a given rotational direction generates said reciprocating linear motion of said pumping element, thereby expelling a quantity of gas from the container to generate at least a partial vacuum; and d) a filter element associated with said one one-way inlet valve.

* * * * *